US007717087B2

(12) United States Patent
Haiser et al.

(10) Patent No.: US 7,717,087 B2
(45) Date of Patent: May 18, 2010

(54) CONNECTION FOR HIGH-PRESSURE CHAMBERS OF FUEL INJECTORS

(75) Inventors: Heinz Haiser, Ludwigsburg (DE); Dominikus Hofmann, Fuessen (DE)

(73) Assignee: Robert Bosch GmbH, Stuttgart (DE)

( * ) Notice: Subject to any disclaimer, the term of this patent is extended or adjusted under 35 U.S.C. 154(b) by 270 days.

(21) Appl. No.: 10/560,911

(22) PCT Filed: Apr. 8, 2004

(86) PCT No.: PCT/DE2004/000743

§ 371 (c)(1),
(2), (4) Date: Dec. 16, 2005

(87) PCT Pub. No.: WO2005/010347

PCT Pub. Date: Feb. 3, 2005

(65) Prior Publication Data

US 2007/0095325 A1 May 3, 2007

(30) Foreign Application Priority Data

Jun. 27, 2003 (DE) ..... 103 29 052

(51) Int. Cl.
*F02M 69/46* (2006.01)

(52) U.S. Cl. ..... 123/456; 123/446

(58) Field of Classification Search ..... 123/456, 123/446, 500; 417/245, 415, 243; 137/209; *F02M 69/46*
See application file for complete search history.

(56) References Cited

U.S. PATENT DOCUMENTS

| | | | | |
|---|---|---|---|---|
| 2,947,258 | A * | 8/1960 | Bessiere | 417/245 |
| 4,700,680 | A * | 10/1987 | Pearce | 123/383 |
| 6,520,155 | B1 | 2/2003 | Boecking | |
| 6,637,407 | B1 | 10/2003 | Boecking | |

FOREIGN PATENT DOCUMENTS

| | | | |
|---|---|---|---|
| DE | 199 48 339 | C1 | 12/2000 |
| DE | 100 22 378 | A1 | 11/2001 |
| DE | 101 52 261 | A1 | 4/2003 |
| WO | WO 03/027484 | A1 | 4/2003 |

OTHER PUBLICATIONS

Nordquist, Richard; Grammar & Composition; 2008; About.com; p. 1.*

* cited by examiner

*Primary Examiner*—Stephen K Cronin
*Assistant Examiner*—Keith Coleman
(74) *Attorney, Agent, or Firm*—Ronald E. Greigg

(57) ABSTRACT

A connection point of a chamber subjected to high pressure in a body subjected to high pressure of a high-pressure injection system for fuel at a bore extending substantially vertically through the body. In the chamber subjected to high pressure of the body, a cylindrically shaped pocket or an encompassing groove is embodied, into which the bore discharges, forming an intersection point.

23 Claims, 4 Drawing Sheets

Fig. 7.1
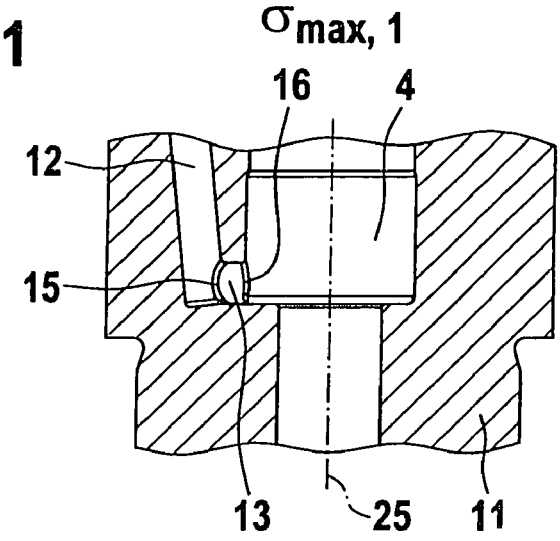
Fig. 7.2
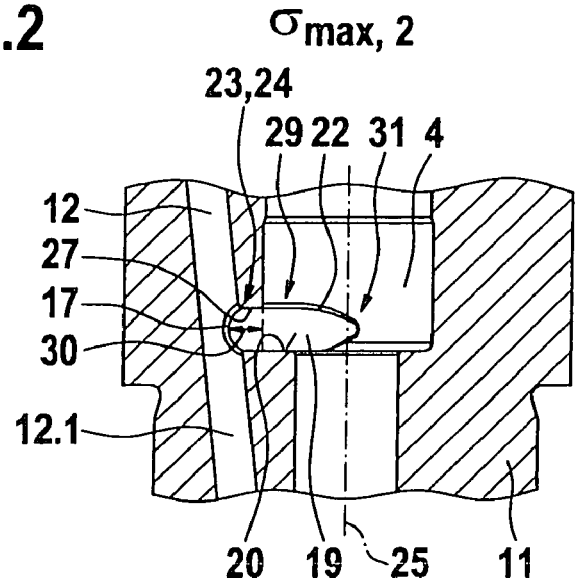
Fig. 7.3
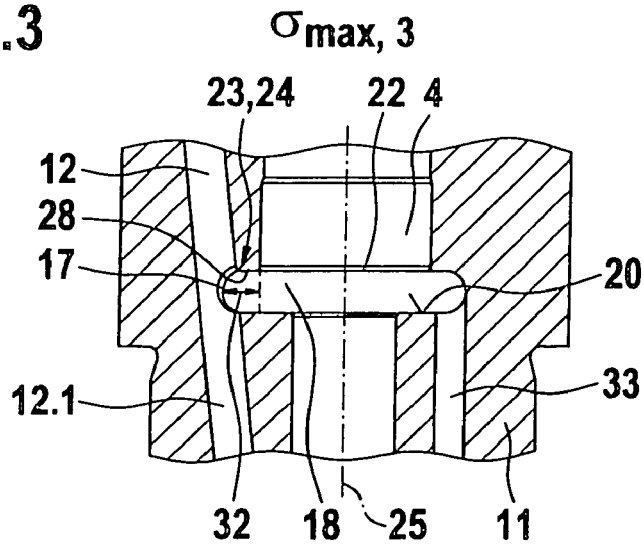

CONNECTION FOR HIGH-PRESSURE CHAMBERS OF FUEL INJECTORS

CROSS-REFERENCE TO RELATED APPLICATIONS

This application is a 35 USC 371 application of PCT/DE 2004/000743 filed on Apr. 8, 2004.

BACKGROUND OF THE INVENTION

1. Field of the Invention

For introducing fuel into direct-injection internal combustion engines, stroke-controlled injection systems with a high-pressure reservoir (common rail) are used, as are unit fuel injector systems or pump-line-nozzle systems. In fuel injection systems with a common rail, the injection pressure can advantageously be adapted to the load and rpm of an engine over wide operating ranges. To reduce emissions and to attain a high specific performance, a high injection pressure is necessary. The attainable pressure level in high-pressure fuel pumps is limited for reasons of strength, so that to further increase the pressure in fuel injection systems, pressure amplifiers in the fuel injectors are employed.

2. Description of the Prior Art

German Patent Disclosure DE 101 23 913 A1 discloses a fuel injection system for internal combustion engines with a fuel injector that can be supplied from a high-pressure fuel source. A pressure booster device having a movable pressure booster piston is connected between the fuel injector and the high-pressure fuel source. The pressure booster piston divides a chamber, which can be made to communicate with the high-pressure fuel source, from a high-pressure chamber that communicates with the fuel injector. For filling a differential pressure chamber of the pressure booster device with fuel or evacuating the differential pressure chamber of fuel, the fuel pressure in the high-pressure chamber can be varied. The fuel injector has a movable closing piston for opening and closing injection openings. The closing piston protrudes into a closing-pressure chamber, so that the closing piston can be acted upon by fuel pressure to attain a force acting in the closing direction on the closing piston. The closing-pressure chamber and the differential pressure chamber are formed by a common closing-pressure differential pressure chamber, and all the portions of the closing-pressure differential pressure chamber communicate permanently with one another from exchanging fuel. A pressure chamber is provided for supplying the injection openings with fuel and for subjecting the closing piston to a force acting in the opening direction. A high-pressure chamber communicates with the high-pressure fuel source in such a way that aside from pressure fluctuations, at least the fuel pressure of the high-pressure fuel source can be applied constantly to the high-pressure chamber; the pressure chamber and the high-pressure chamber are formed by a common injection chamber. All the portions of the injection chamber communicate permanently with one another for exchanging fuel.

German Patent Disclosure DE 102 47 903.8 A1 discloses a pressure-amplified fuel injection system with an internal control line. The fuel injection system, which communicates with a high-pressure source, has a multi-part injector body. In it, a pressure booster that can be actuated via a differential pressure chamber is received, and its pressure booster piston divides a work chamber from the differential pressure chamber. The fuel injection system is actuatable via a switching valve. A change in pressure in the differential pressure chamber of the pressure booster is effected via a central control line, which extends through the pressure booster piston. The central control line is passed through the work chamber of the pressure booster and is sealed off from it via a high-pressure-proof connection.

German Patent Disclosure DE 196 11 884 A1 relates to a fuel injection valve for internal combustion engines. It includes a pistonlike valve member that is axially displaceable in a bore of a valve body. This valve member, on its end toward the combustion chamber, has a valve sealing face, which to open an injection cross section cooperates with a valve seat provided on the end of the bore toward the combustion chamber. Moreover, the valve member has a pressure shoulder, pointing in the direction of the valve sealing face, by means of which shoulder the valve member is subdivided into a larger-diameter guide part guided slidingly in the bore and a smaller-diameter free shaft part. A pressure chamber formed by a cross-sectional expansion of the bore is provided, which communicates with the valve seat via a gap formed between the free shaft of the valve member and the wall of the bore and which is adjoined, on the end facing away from the valve seat, by a guide portion of the bore that receives the guide part of the valve member. The valve body is penetrated by a pressure conduit, which discharges radially outward of the bore into the end of the pressure chamber facing away from the valve seat. The pressure shoulder on the valve member constantly plunges so far into the guide portion of the bore that an annular gap remains between the valve member and the wall of the bore on the end of the guide portion of the bore adjacent to the pressure chamber. In this gap, a contrary force on a remaining web between the bore and the pressure conduit is built up.

In previous version of pressure amplifiers controlled via the differential pressure chamber, the differential pressure chamber communicates, through what is as a rule a horizontal bore, with a second, valve-carrying bore. The horizontal bore proves to be extremely difficult to make. Time-consuming, expensive processes such as electrochemical countersinking or erosion must be employed. Moreover, at the intersection points between the differential pressure chamber and the horizontal bore, the maximum stresses occur in the component. High surface quality and rounding off of the edges that necessarily occur in manufacture, given the desired system pressures that must still be increased further, no longer suffice to obtain durable components. The internal central control line known from DE 102 47 903 A1 requires greater effort and expense of production and assembly than simple bores inside the injector body.

SUMMARY OF THE INVENTION

In designing pressure amplifiers controlled via the differential pressure chamber, the connection of the differential pressure chamber to the control line represents a potential weak point. Since the control valve for actuating the pressure amplifier, for reasons of installation space, is located above the pressure amplifier, the control line is made to run laterally past the pressure amplifier. In the embodiment proposed according to the invention, the connection between the differential pressure chamber and the control line, which as a rule is embodied as a bore and leads to the valve, is represented by an encompassing groove or a lateral pocket in the cylindrical differential pressure chamber of the pressure amplifier. The resultant advantage is that above all at the high-pressure intersection point between the differential pressure chamber and a groove, or between the differential pressure chamber and the cylindrically shaped pocket, no excessive increase in stresses whatever that impair the pressure resistance of the fuel injector are created. The excessive increase in stress at the high-pressure intersection point between the groove and the control line embodied as a bore, or between the cylindrically shaped pocket and the control line embodied as a bore, can be reduced substantially, so that with a fuel injector of this kind with optimized communication between the high-pressure chambers at the pressure booster, higher injection pressures can be achieved.

A further advantage of the embodiment proposed according to the invention is that an intersection point that is not sensitive to tolerances is attained between the groove or pocket and the control line embodied as a bore, since purely mechanical, metal-cutting production processes can be employed for producing the groove or the pocket.

By means of suitable shaping of the groove or of the cylindrically shaped pocket, specific shapes of the opening can thus be achieved that are geometrically oval, rectangular, or otherwise-shaped. By means of a defined shape of the opening, the stresses in the region of the high-pressure intersection point between the groove and the control line embodied as a bore, or between the cylindrically shaped pocket and the control line embodied as a bore, can be varied in a purposeful way and additionally reduced still further. With connection points embodied in this way in the high-pressure region between high-pressure chambers of components that are exposed to extreme pressures, on the one hand, over the long term, the service lives of fuel injectors with pressure amplifiers can be increased because of the lower stress level; on the other hand, by means of the connection proposed according to the invention of high-pressure chambers of components carrying extremely high pressure, it is possible to increase the injection pressure amplified in fuel injectors still further.

BRIEF DESCRIPTION OF THE DRAWINGS

The invention is described in detail below, in conjunction with the drawings in which:

FIG. 7.1 is a sectional view of a connection of a differential pressure chamber of a pressure amplifier to a control line embodied as a bore;

FIG. 7.2 is a view similar to FIG. 7.1 of a connection configured according to the invention of a control line embodied as a bore to the differential pressure chamber of a pressure amplifier; and FIG. 7.3 is a connection embodied as an encompassing groove, of a differential pressure chamber of a pressure amplifier, with a control line embodied as a bore.

DESCRIPTION OF THE PREFERRED EMBODIMENTS

Figure 1:
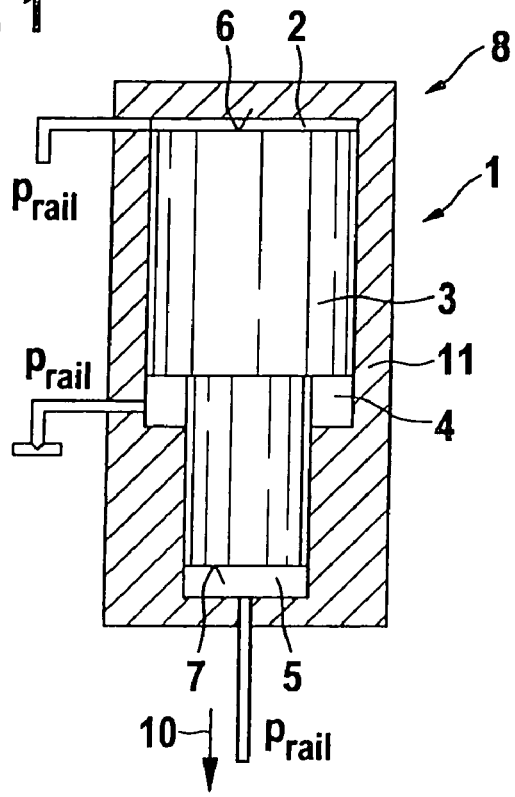
FIG. 1 is a sectional view of a pressure amplifier, activated via pressure variations in a differential pressure chamber, in the nonactivated state.

FIG. 1 schematically shows a pressure amplifier whose work chamber is separated via an amplifier piston from a differential pressure chamber that can be relieved of pressure or subjected to pressure.

A pressure amplifier 1 includes a work chamber 2 and a differential pressure chamber 4 that can be relieved of pressure or subjected to pressure. The pressure amplifier 1 further includes a compression chamber 5 embodied in the body 11 of the pressure amplifier. The amplifier piston 3 that divides the differential pressure chamber 4 from the work chamber 2 includes a first end face 6 and a second end face 7 that defines the compression chamber 5. Via a high-pressure source, not further shown in FIG. 1, the work chamber 2 of the pressure amplifier 1 is subjected to system pressure ($p_{rail}$). The system pressure ($p_{rail}$) also prevails in the differential pressure chamber 4. In the compression chamber 5 of the pressure amplifier 1, which is shown in its deactivated position 8 in FIG. 1, system pressure level $p_{rail}$, also prevails. The pressure amplifier 1 is accordingly in pressure equilibrium, since the pressure forces applied to the second end face 7 and to the annular face in the differential pressure chamber 4 of the pressure amplifier 1 correspond to the pressure force engaging the first end face 6 of the amplifier piston 3.

Figure 2:
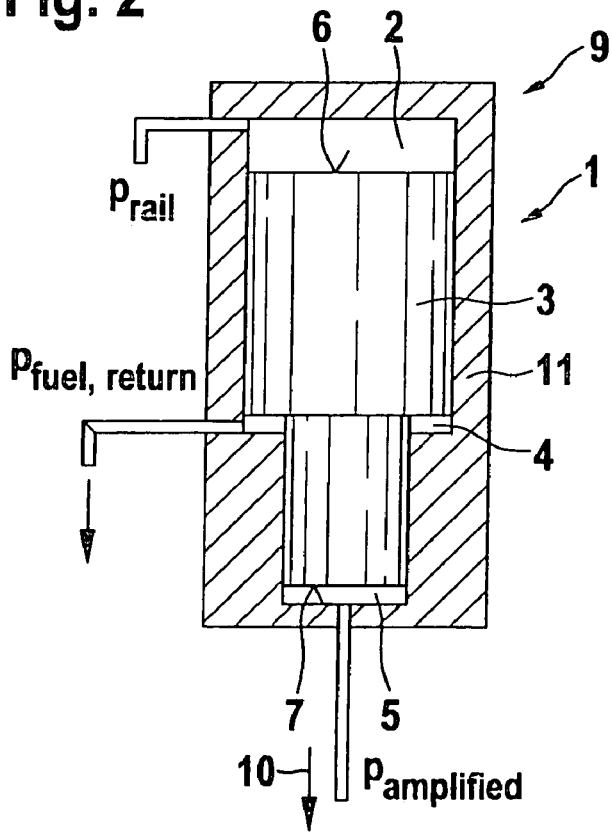
FIG. 2, the pressure amplifier of FIG. 1 in the activated state.

FIG. 2 shows the pressure amplifier of in FIG. 1, but in its activated state. Via a pressure relief of the differential pressure chamber 4 to a pressure level $p_{fuel,return}$, the amplifier piston 3, because of the pressure force in the work chamber 2, which is generated by the system pressure ($p_{rail}$) and engages the first end face 6 of the amplifier piston, moves into the compression chamber 5. The second end face 7, which defines the compression chamber 5 of the pressure amplifier 1, compresses the fuel supply contained in the compression chamber 5 to an elevated pressure level ($p_{amplified}$), which is attainable in accordance with the design ratio of the pressure amplifier piston 3, which is carried in the region of an inlet 10 to an injection valve member, not shown in FIG. 2.

Figure 3:
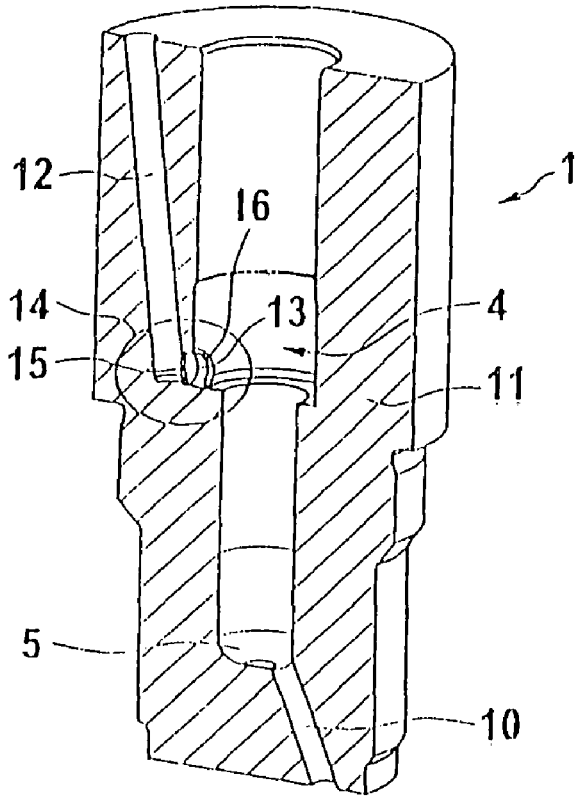
Fig. 3 Prior Art
FIG. 3 is a sectional view, in perspective, of a pressure amplifier whose differential pressure chamber communicates by means of a horizontal bore with a control line embodied as a bore.

FIG. 3 shows a half-section through a body of a pressure amplifier of the prior art. The pressure amplifier 1 includes a body 11, in which a control line 12 embodied as a bore extends. The control line 12 embodied as a bore communicates with the differential pressure chamber 4 of the pressure amplifier 1 via a horizontal bore 13. he horizontal bore 13 is a critical region in terms of the stress level that is established in operation of the pressure amplifier 1. Within the critical region 14, also called an intersection region, both a first intersection point 15 with the control line 12 embodied as a bore and with the horizontal bore 13 and a second, critical intersection point 16 between the horizontal bore 13 and the differential pressure chamber 4 of the pressure amplifier 1 develop. In operation of the pressure amplifier 1, the greatest stresses occur at these intersection points 15 and 16 and decisively impair the durability of this kind of pressure amplifier 1 with a horizontal bore 13. The compression chamber 5 is shown in half-section through the body 11 of the pressure amplifier 1 in the view in FIG. 3, and from it, at an angle that depends on the design of the pressure amplifier 1, the inlet 10 branches off to an injection valve member, not shown in FIG. 3.

Figure 4:
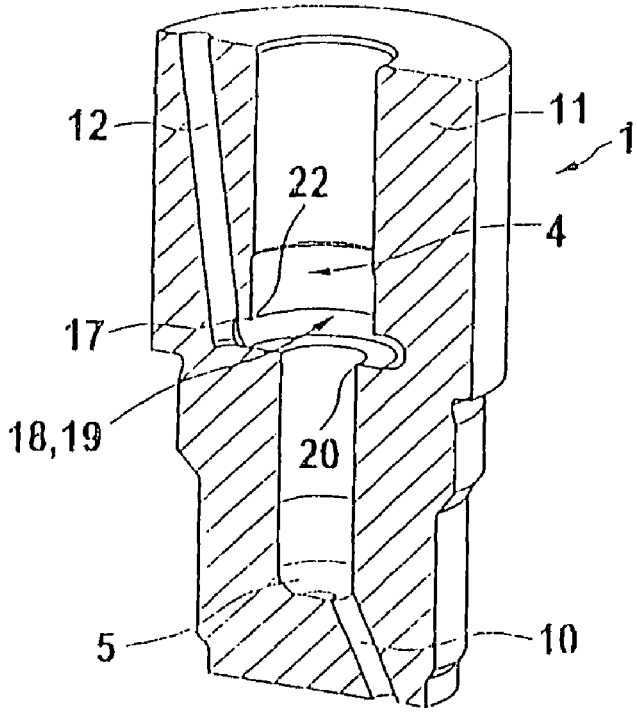
FIG. 4 is a view similar to FIG. 3 showing a connection configured according to the invention of a differential pressure chamber in the body of the pressure amplifier, with a control line embodied as a bore.

FIG. 4 shows a variant embodiment of the invention of a connection between the control line 12, embodied as a bore, and a differential pressure chamber of a pressure amplifier. It can be seen that at the lower end of the differential pressure chamber 4 of the pressure amplifier 1, an encompassing groove 18 or a cylindrically shaped pocket 19 may be embodied. In accordance with the embodiment proposed according to the invention, between the encompassing groove 18 or the cylindrically shaped pocket 19, a first bore intersection 17 is established, while a second bore intersection 22 is formed between the differential pressure chamber 4 of the pressure amplifier 1 and the cylindrically shaped pocket 19 or the encompassing groove 18. The differential pressure chamber 4 is defined on its lower end by an annular face 20; the compression chamber 5 is shown in half-section in FIG. 4 on the lower end of the body 11 of the pressure amplifier 1, and from it, at an angle of inclination, an inlet 10 branches off to the injection valve member, not shown in FIG. 4.

Figure 5:
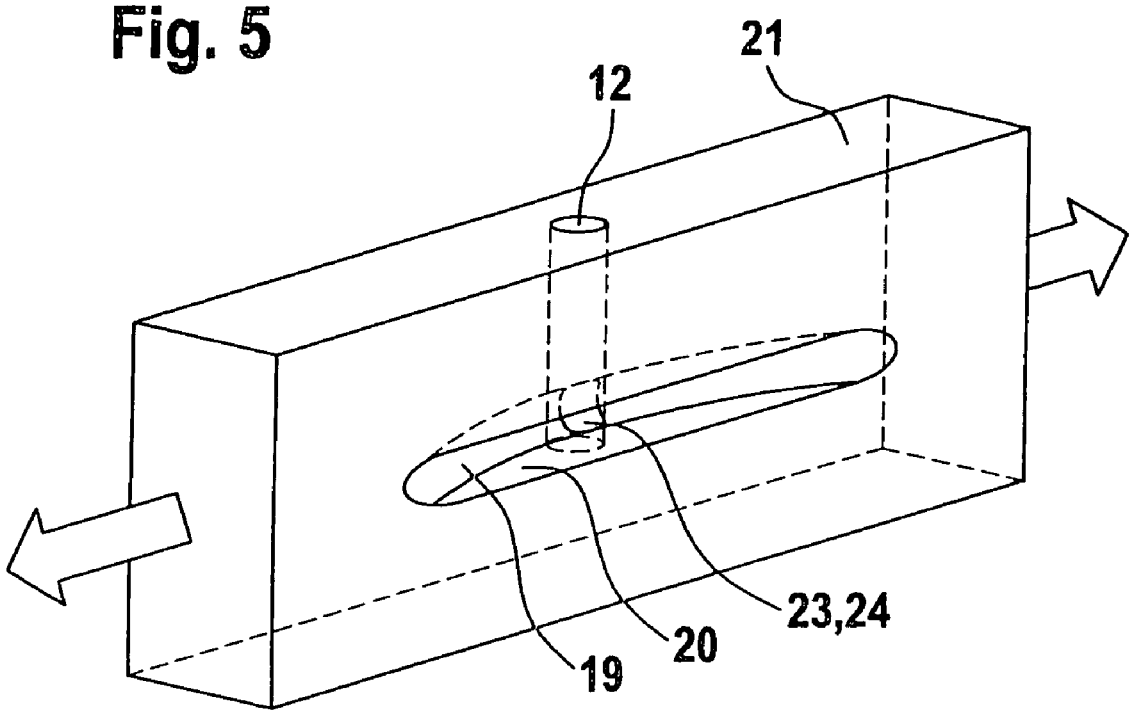
FIG. 5 is a developed boundary wall of a pressure chamber, in which a cylindrically shaped pocket is embodied that with a control line embodied as a bore forms a connection.

The view in FIG. 5 shows a boundary wall, shown in a developed, extended position of 180°, of a high-pressure container with a cylindrically shaped pocket.

In the developed view of FIG. 5, the boundary wall of the differential pressure chamber 4 of a pressure amplifier is shown in a 180° extended position. The tangential stresses caused in the body 11 of the pressure amplifier 1 by the internal pressure in the differential pressure chamber 4 act as tensile stresses represented by the two arrows pointing away from one another. In the region in which two bores would meet one another, the notch effects that occur at the intersection point 15 in FIG. 3 are added together along the bores 12 and 13, the result being a pronounced excessive increase in stress. In the view in FIG. 5, however, the connection of the control line 12, embodied as a bore, to the differential pressure chamber 4 is embodied as a cylindrically shaped pocket 19, which does not exhibit any notch effect. In comparison to the connection of the differential pressure chamber 4 to the control line 12 embodied as a bore in FIG. 3 by means of a horizontal bore 13, the embodiment of the connection according to the invention as shown in FIG. 5 produces only one notch effect point 23 along the bore 12, at which, in comparison to the two notch effect points 15 and 16 that result in FIG. 3, a considerably lesser stress level is established.

Figure 6:
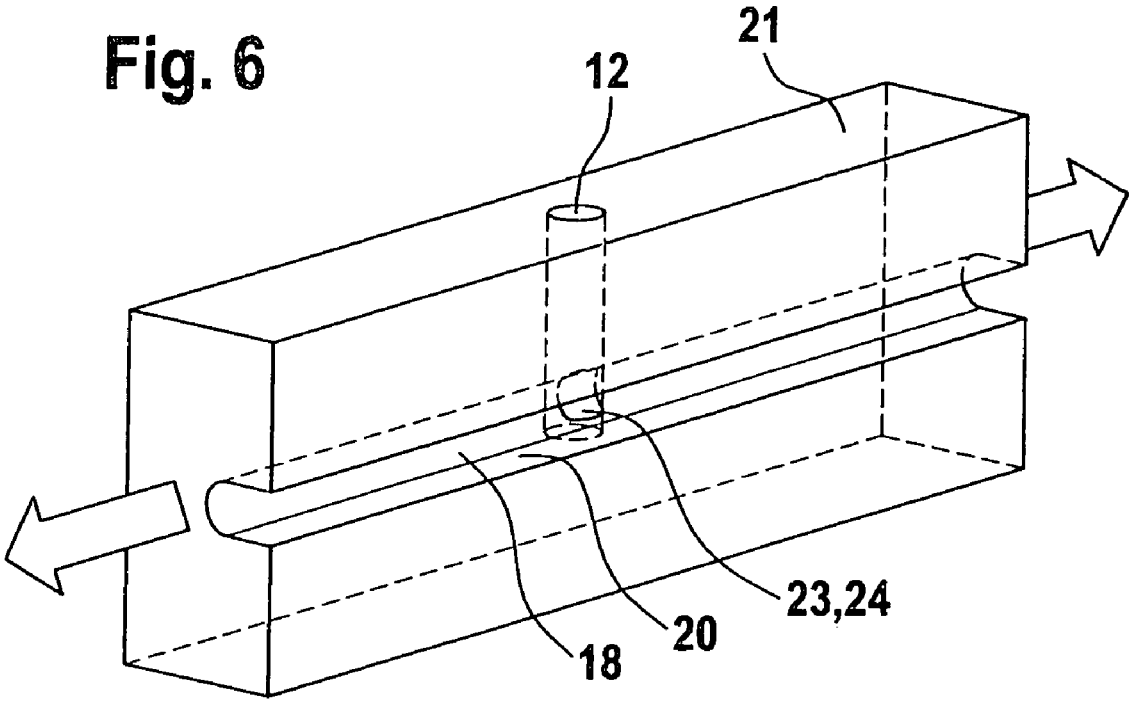
FIG. 6 is a developed boundary wall of a high-pressure container, in which an encompassing groove, also shown in a developed view, is made that likewise communicates with a control line embodied as a bore.

In the view in FIG. 6, the connection of a high-pressure chamber by means of an encompassing groove to a control line embodied as a bore is shown. In this embodiment of a connection of a high-pressure chamber to a control line 12 embodied as a bore, an encompassing groove 18 shown in a developed view is let into a wall 21, also shown in a developed view, of a high-pressure chamber, such as a differential pressure chamber 4 of a pressure amplifier 1. The encompassing groove 18 is free of notch effects; along the bore 12, the notch effect point 23 forms, which represents the location where the maximum stresses 24 occur. The tangential stresses that occur in the component, that is, in the body 11, are also shown in the view in FIG. 6, as tensile stresses in the developed view of the wall 21 of the body 11.

In the two variant embodiments, shown in FIGS. 5 and 6, of a connection of a chamber that carries high pressure to a control line 12 embodied as a bore and extending vertically into the body 11, only one notch effect point 23 is embodied in each case. If the notch effects along the bores 12 and 13 meet at the intersection point 15 of the horizontal bore 13 in FIG. 3 and the control line 12 embodied as a bore, so that in accordance with the variant embodiments known from the prior art and shown in FIG. 3, the notch effects are added together and lead to a pronounced excessive increase in stress in the component 11.

By comparison, an encompassing groove 18 as in FIG. 6 does weaken the total cross section of the body 11 somewhat, but with a view to the resultant mechanical load, the encompassing groove 18 does not act like a notch under tensile stress. As a result, an excessive increase in stress at the notch effect point 23 is avoided, so that only one notch effect point 23 is embodied, which represents the location 23 where the maximum stresses occur. In comparison to the variant embodiment of FIG. 3 where the connection is designed as a horizontal bore 13, however, a considerably lesser stress level is established at the notch effect point 23. If conversely the connection between the control line 12 embodied as a bore and a container carrying high pressure is designed as a cylindrically shaped pocket 19, this variant embodiment of the connection offers the advantage that the cylindrically shaped pocket 19 results in a lesser idle volume in comparison to an encompassing groove 18; that is, the high-pressure container can be filled with a lesser volume if the connection is embodied as a cylindrically shaped pocket 19. f the idle volume, for instance in the differential pressure chamber 4 of the pressure amplifier 1, can be reduced, this advantageously leads to an increase in efficiency; moreover, the hydraulic adaptation can be improved, and last but not least—in the case of a pressure amplifier—smaller diversion quantities are moved upon activation of the pressure amplifier.

FIG. 7.1 shows a connection of a differential pressure chamber to a control line, embodied as a bore, by means of a horizontal bore. The differential pressure chamber 4 is embodied symmetrically to an axis of symmetry 25. The control line 12 and the differential pressure chamber 4 communicate with one another via the horizontal bore 13, so that the first intersection point 15 results between the horizontal bore 13 and the control line 12, and the second intersection point 16 is represented at the horizontal bore 13 and the differential pressure chamber 4. The notch effects that form at the intersection point 15 are added together, resulting in a first, very high stress level $\sigma_{max,1}$ during operation of the pressure amplifier.

In the view shown in FIG. 7.2, the connection of the differential pressure chamber to the control line embodied as a bore is embodied by a cylindrically shaped pocket. The cylindrically shaped pocket 19 is molded into the inner wall in the lower region of the differential pressure chamber 4. The cylindrically shaped pocket 19 forms the connection point between the control line 12, embodied as a bore, and the differential pressure chamber 4 in the body 11. The control line 12 can be embodied as either a blind bore (FIG. 7.1) or a through bore 12.1. Because of the shape of the connection point as a cylindrically shaped pocket 19, a first bore intersection 17 is established, which represents the notch effect point 23. In contrast to the view in FIG. 7.1, only one notch effect contribution by the bore intersection 17 is shown. This notch effect point 23 represents the location 24 where a maximum stress $\sigma_{max,2}$ occurs, which is considerably below the additive maximum stress $\sigma_{max,1}$ that occurs in FIG. 7.1. As a result, in operation of a high-pressure container, such as a differential pressure chamber 4 of a pressure amplifier, the stress level that occurs in its body 11 can be reduced by up to 30%. The cylindrically shaped pocket 19 is molded in the lower region of the inner wall of the differential pressure chamber 4 in the body 11 and moreover produces an only slight increase in the idle volume inside the differential pressure chamber 4. The maximum height of the cylindrically shaped pocket 19 is represented by reference numeral 30; the cylindrically shaped pocket 19 extends symmetrically and semicircularly and ends in ending regions 31 in the inner wall of the differential pressure chamber 4. The notch effect that occurs at the second bore intersection 22 between the cylindrically shaped pocket 19 and the wall of the differential pressure chamber 4 is negligible, compared to the excessive increase in stress caused by the notch effect at the first bore intersection 17.

FIG. 7.3 shows the embodiment in cross section, in which the connection of the control line embodied as a bore to the differential pressure chamber is effected via an encompassing groove in the body subjected to pressure. In this variant embodiment, the encompassing groove 18, which is embodied with a constant height 32, forms a first bore intersection 17. The first bore intersection 17 marks the transition point from the control line 12 embodied as a bore to the encompassing groove 18; a second bore intersection 22 is also established, which represents the transitional region between the differential pressure chamber 4 and the encompassing groove 18. The lower annular face of the encompassing groove 18 is identified by reference numeral 20. Further bores 33 may be connected to the encompassing groove 18, of which one is shown in FIG. 7.3. The intersection 17 between the control line 12 embodied as a bore and the encompassing groove 18 represents the notch effect point 23, which represents the location 24 of the maximum stress $\sigma_{max,3}$. In comparison to the maximum stress a $\sigma_{max,2}$ that occurs in the variant embodiment of FIG. 2, the maximum stress $\sigma_{max,3}$ that occurs in the variant embodiment of FIG. 7.3 is reduced still further.

The contour of the encompassing groove 18 and of the cylindrically shaped pocket 19 can be embodied as curved, angular, with rounded corners, or with some other geometry.

The versions shown in FIGS. 5, 6 and FIGS. 7.2 and 7.3 of connection points between chambers carrying high pressure and a bore extending substantially vertically through a body avoid sharp-edged transitions and thereby make it possible reduce the incident stress level. The reduction in the maximum stress occurring in the body 11 caused by tangential stress upon subjection of the differential pressure chamber 4 to pressure, for instance in a pressure amplifier 1, makes it possible on the one hand to further increase the pressure amplifier inside the body 11 and on the other, while maintaining the currently prevailing pressure amplifier, a lengthening of the service life of a pressure-carrying body 11.

The foregoing relates to preferred exemplary embodiments of the invention, it being understood that other variants and embodiments thereof are possible within the spirit and scope of the invention, the latter being defined by the appended claims.

The invention claimed is:

1. In a connection point of a bore to a differential pressure chamber of a pressure amplifier, the pressure amplifier having a body with an interior chamber, and a piston within the body, which piston separates the chamber of the body into a work chamber (2) a compression chamber (5) and the differential pressure chamber (4), wherein the differential pressure chamber is subjected to the high pressure of a high-pressure injection system for fuel or relieved of such pressure, and the bore extends through the body, the improvement comprising a cylindrically shaped pocket or an encompassing groove in the differential pressure chamber, the bore discharging into the cylindrical shaped pocket or the encompassing groove thus forming an intersection point, wherein the bore forms a control line that subjects the differential pressure chamber to the high pressure of the fuel system or relieves it of said pressure by connecting it to a valve which thus actuates the pressure amplifier.

2. In a high-pressure fuel injection system having a pressure amplifier that includes a body and a differential pressure chamber, the differential pressure chamber being connected to a bore which extends through the body and connects to a valve, the improvement comprising a cylindrically shaped pocket or an encompassing groove in a cylindrical wall of the differential pressure chamber, and that the bore discharges into the cylindrical shaped pocket or the encompassing groove thus forming an intersection point so that the valve, via its connection to the bore and thus to the differential pressure chamber subjects the differential pressure chamber to pressure or relieves it of pressure and thus actuates the pressure amplifier.

3. The improvement according to claim 2, wherein the cylindrically shaped pocket or the encompassing groove forms an intersection with the bore that is free of excessively elevated stress.

4. The connection point according to claim 1, wherein the intersection point acts as a notch effect point, at which reduced stress levels $\sigma_{max,2}$, $\sigma_{max,3}$ are established in operation of the body subjected to high pressure.

5. The improvement according to claim 2, wherein the cylindrically shaped pocket or the encompassing groove is an encompassing groove which is embodied with a curved or angular contour at a constant depth in the body.

6. The improvement according to claim 2, wherein the cylindrically shaped pocket or the encompassing groove is a cylindrically shaped pocket which is embodied as semicircular, curved, or angular in the cylindrical wall that defines the chamber.

7. The improvement according to claim 6, wherein the cylindrically shaped pocket has its maximum depth at the orifice of the bore.

8. The connection point according to claim 1, wherein the connection point is embodied, depending on the shape of the groove, as an opening of oval or rectangular geometry.

9. The connection point according to claim 1, wherein the control line is embodied as a through bore in the high-pressure-carrying body.

10. The improvement according to claim 2, further comprising at least one further bore connected to the cylindrically shaped pocket or the encompassing groove in the high-pressure-carrying body.

11. In a connection point of a cylindrical chamber subjected to high pressure in a body subjected to high pressure of a high-pressure injection system, with a bore extending through the body, the improvement comprising a cylindrically shaped pocket or an encompassing groove in the cylindrical wall of the cylindrical chamber of the body, the bore discharging into the cylindrical shaped pocket or the encompassing groove and thus forming an intersection point within the cylindrical shaped pocket or the encompassing groove.

12. The connection point according to claim 11, wherein the cylindrically shaped pocket or the encompassing groove is preferably disposed in the bottom region of the cylindrical wall of the cylindrical chamber.

13. The connection point according to claim 11, wherein the cylindrically shaped pocket or the encompassing groove forms an intersection with the bore that is free of excessively elevated stress.

14. The connection point according to claim 11, wherein the intersection point acts as a notch effect point, at which reduced stress levels $\sigma_{max,2}$, $\sigma_{max,3}$ are established in operation of the body subjected to high pressure.

15. The connection point according to claim 11, wherein the cylindrically shaped pocket or the encompassing groove is an encompassing groove which is embodied with a curved or angular contour at a constant depth in the body.

16. The connection point according to claim 11, wherein the cylindrically shaped pocket or the encompassing groove is a cylindrically shaped pocket which is embodied as semicircular, curved, or angular in the cylindrical wall that defines the chamber.

17. The connection point according to claim 16, wherein the cylindrically shaped pocket has its maximum depth at the orifice of the bore.

18. The connection point according to claim 16, wherein the cylindrically shaped pocket, on both sides of the orifice of the bore, has symmetrical ending regions into the bore.

19. The connection point according to claim 11, wherein the connection point is embodied, depending on the shape of the groove, as an opening of oval or rectangular geometry.

20. The connection point according to claim 11, defined by the intersection of a differential pressure chamber, controlling a pressure amplifier, and a control line in the form of a bore that subjects the differential pressure chamber to pressure or relieves it of pressure and that leads to a valve that actuates the pressure amplifier.

21. The connection point according to claim 11, wherein the control line is embodied as a through bore in the high-pressure-carrying body.

22. The connection point according to claim 11, further comprising at least one further bore connected to the encompassing groove or the encompassing groove in the high-pressure-carrying body.

23. The improvement according to claim 2, wherein the cylindrically shaped pocket or the encompassing groove is preferably disposed in the bottom region of the differential pressure chamber subjected to high pressure.

* * * * *